United States Patent [19]

Levine et al.

[11] Patent Number: 4,909,464

[45] Date of Patent: Mar. 20, 1990

[54] DEFLECTABLE PRICE CHANNEL-MOUNTED SIGN HOLDER

[75] Inventors: Stanley L. Levine, Greenwood Lake; Lee R. Wiese, Upper Nyack, both of N.Y.

[73] Assignee: Henschel-Steinau, Inc., Englewood, N.J.

[21] Appl. No.: 377,619

[22] Filed: Jul. 10, 1989

[51] Int. Cl.[4] ..... G09F 3/20

[52] U.S. Cl. ..... 248/225.1; 248/417; 248/289.3; 248/223.4; 248/221.4; 40/642; 40/611; 40/649; 16/284

[58] Field of Search ..... 248/225.1, 417, 289.3, 248/223.4, 221.4; 16/284, 280; 40/584, 642, 611, 650, 649

[56] References Cited

U.S. PATENT DOCUMENTS

| | | | |
|---|---|---|---|
| 2,178,751 | 11/1939 | Glasgow | 248/289.3 |
| 2,186,241 | 1/1940 | Glasgow | 248/289.3 |
| 2,685,102 | 8/1954 | Forkey | 16/284 |
| 2,787,433 | 4/1957 | Slavsky et al. | 248/289.3 X |
| 3,015,897 | 1/1962 | Hopp | 40/650 |
| 3,070,911 | 1/1963 | Slavsky | 40/642 |
| 3,518,716 | 7/1970 | Larson | 16/284 |
| 3,552,702 | 1/1971 | Springer | 248/316.7 |
| 4,686,785 | 8/1987 | Obbermito | 40/611 X |
| 4,805,331 | 2/1989 | Boggess et al. | 40/611 X |

*Primary Examiner*—David M. Purol

*Attorney, Agent, or Firm*—Samuelson & Jacob

[57] ABSTRACT

A sign holder includes a frame secured to a clevis journaled on a bracket for attachment to a price channel at the edge of a display shelf for projecting the frame, and a sign carried in the frame, laterally from the shelf edge into a display position of the sign, the clevis including an integral camming surface and a resiliently flexible arm for allowing swinging of the frame relative to the bracket out of the display position of the sign in response to collisions with the sign when the frame is in the display position of the sign, the establishing a biasing force tending to return the frame to and maintain the frame in the display position of the sign.

7 Claims, 1 Drawing Sheet

DEFLECTABLE PRICE CHANNEL-MOUNTED SIGN HOLDER

The present invention relates generally to the display of signs and pertains, more specifically, to signs which are projected directly into the traffic pattern of shoppers and, for reasons of safety, must be deflected readily upon contact so as to avoid injury.

The myriad of merchandise placed before shoppers in self-service shopping has led to the development of a variety of displays designed to draw attention to particular items offered for sale. One such development places a conspicuous sign adjacent the offered items by attaching the sign to the edge of a shelf upon which the items are placed in such a way as to extend the sign out from the shelf directly into the pattern of traffic followed by the shoppers. A common procedure is to attach the sign to an existing price channel which extends longitudinally along the edge of the shelf. While such signs attain the desired objective of calling attention to the items on the shelf, the projecting signs pose a potential hazard in that a shopper can collide with the protruding structure, causing injury to the shopper. Even if no injury results, the protruding signs can be dislodged or damaged by such collisions, thereby defeating the purpose of the signs.

In an effort to solve the above-outlined problems, sign holders have been developed which can be deflected in response to a collision, without causing injury, and without dislodging or damaging the sign. Mechanisms have been provided for assuring that the signs, once deflected, are returned automatically to the projecting position so that the function of the sign is not impaired. However, many of these mechanisms are relatively complex and tend to increase the cost of the sign holder, thereby discouraging the use of such sign holders. The present invention provides a sign holder of the tape which places a sign in the desired projected display position and tends to maintain the sign in the display position, while enabling ready deflection in response to contact with passing shoppers or other traffic, and exhibits several objects and advantages, some of which may be summarized as follows: Provides a simplified, lower cost construction which encourages the more widespread use of a safer sign holder; Enables reliable operation to reduce any potential hazard to shoppers; Reduces the frequency of replacement of the display signs, thereby saving not only the cost of the sign holders, but the labor involved in maintaining the signs in place; Provides an aesthetically pleasing display which is effective, yet unobtrusive; Provides a compact structure which utilizes a minimum of space at the installation site, as well as during shipping and storage; Utilizes a minimum number of component parts, all of which may be constructed economically of inexpensive materials for reduced cost without compromising effectiveness; Enables reliable operation over a relatively long service life.

The above objects and advantages, as well as further objects and advantages, are attained by the present invention which may be described briefly as an improvement in a sign holder for use in connection with a price channel extending in longitudinal direction along a self edge to locate a sign for display beyond the shelf edge in a display position where the sign projects laterally from the price channel and to bias the sign into the display position while permitting swinging movement of the sign out of the display position in response to forces applied to the sign holder in directions generally parallel to the longitudinal direction, the sign holder including a sign frame within which the sign is held and a bracket for selectively attaching the sign frame to the price channel, the improvement comprising: a clevis having transversely opposite, laterally extending first and second arms and a transverse leg interconnecting the first and second arms; affixing means for affixing the sign frame to the clevis; a first camming surface on the clevis adjacent the first arm; a first bearing surface carried by the second arm and confronting the first camming surface; at least one of the first and second arms being resiliently deflectable in transverse directions relative to the other of the first and second arms; a second camming surface on the bracket and being generally complementary to the first camming surface; a second bearing surface on the bracket spaced transversely from the second camming surface and being generally complementary to the first bearing surface such that the clevis and the bracket may be nested in a rest position wherein the first camming surface is engaged with the complementary second camming surface, and the first bearing surface is engaged with the complementary second bearing surface; and pivot means connecting the nested clevis and bracket for pivotal movement of the clevis relative to the bracket about a transverse axis such that any movement of the sign frame away from the display position of the sign will result in pivotal movement of the clevis relative to the bracket and consequent operation of th first and second camming surfaces for deflection of at least one of the first and second arms transversely away from the other of the first and second arms to establish a resilient biasing force tending to return the clevis to the rest position and the sign frame to the display position of the sign.

The invention will be understood more fully, while still further objects and advantages will become apparent, in the following detailed description of a preferred embodiment of the invention illustrated in the accompanying drawing, in which.

Figure 1:
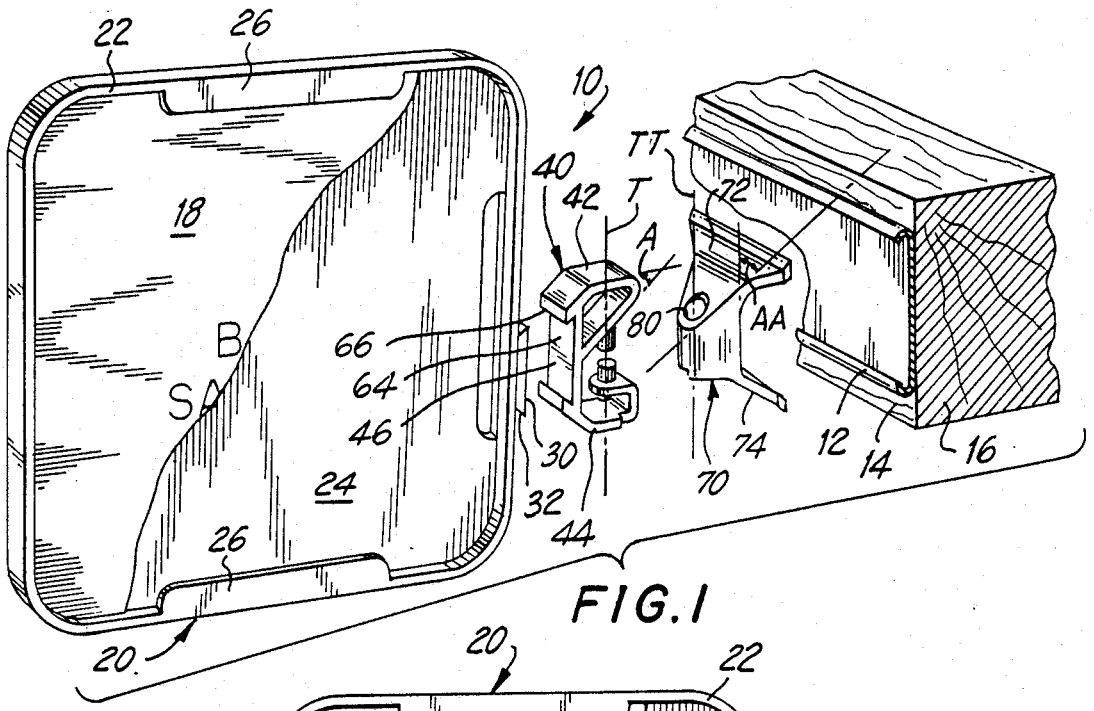
FIG. 1 is an exploded perspective view of a sign holder constructed in accordance with the invention.

Referring now to the drawing, and especially to FIG. 1 thereof, a sign holder constructed in accordance with the invention is illustrated at 10 and is seen about to be attached to a price channel 12 which is affixed to and extends longitudinally along the shelf edge 14 of a shelf 16 upon which there will be displayed items for sale. The attention of shoppers passing by the shelf 16 is to be directed to the items (not shown) on the shelf 16 by means of a sign 18 to be projected laterally beyond the shelf edge 14 and the price channel 12 into the path of traffic followed by the shoppers as the shoppers peruse the multitude of shelves of merchandise.

Sign holder 10 includes a frame 20 having a peripheral rim 22 and a web 24 within the rim 22. The sign 18 is retained within the frame 20, against the web 24, by retaining lips 26 which are integral with the frame 20 and overlap the sign 18 along portions of the periphery thereof. A tongue 30 projects in a lateral direction from the frame 20 and is integral therewith. Tongue 30 has a dovetail configuration 32 for purposes which will be described below. A clevis 40 has a generally C-shaped configuration and includes laterally extending opposite arms 42 and 44 interconnected by a transverse leg 46 (also see FIGS. 2 and 3). A brace 48 extends between the first, or upper arm 42 and the leg 46 and makes an angle A of 45° with each of the arm 42 and the leg 46 so that the upper portion of the clevis 40, comprising the triangular section formed by the brace 48, the leg 46 and the arm 42, is relatively rigid. By contrast, the second, or lower arm 44 is cantilevered and is resiliently deflectable in transverse directions, toward and away from the first arm 42. Second arm 44 carries a pad 50 integral with the free end 52 of the second arm 44 and spaced transversely therefrom by means of a connecting transverse post 54. An inclined surface 56 extends along the brace 48 and confronts a bearing surface 58 on the pad 50. An upper pin 60 extends transversely downward from the inclined surface 56 on the brace 48, and a lower pin 62 extends transversely upward from the bearing surface 58 on the pad 50, both the upper and lower pins 60 and 62 being aligned along the same transverse axis T. A groove 64 in the leg 46 of the clevis 40 has a dovetail configuration 66 complementary to the dovetail configuration 32 of the tongue 30.

A bracket 70 includes upper and lower resiliently deflectable fingers 72 and 74, respectively, projecting laterally for reception within the price channel 12 to selectively secure the bracket 70 to the price channel 12. A second inclined surface 76 on the bracket 70 extend at an angle AA of 45° and is complementary to the first inclined surface 56 on the clevis 40. Likewise, a second bearing surface 78 on the bracket 70 is complementary to the first bearing surface 58 on the clevis 40, the transverse spacing between the inclined surface 76 and the bearing surface 78 of the bracket matching the transverse spacing between the inclined surface 56 and the bearing surface 58 of the clevis 40 so that the bracket 70 may be nested within the clevis 40, as will be described below. An aperture 80 at the inclined surface 76 is aligned along a transverse axis TT with another aperture 82 at the bearing surface 78, the apertures 80 and 82 being complementary to the pins 60 and 62, respectively, on the clevis 40.

Figure 2:
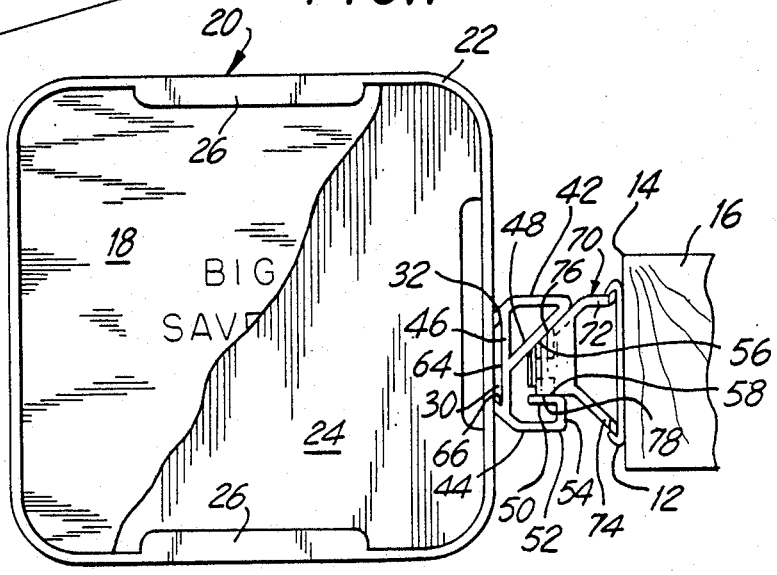
FIG. 2 is a front elevational view of the sign holder.
Figure 3:
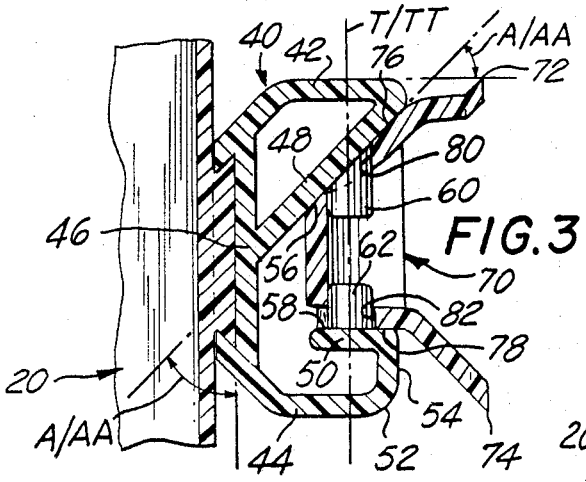
FIG. 3 is an enlarged fragmentary view of a portion of the sign holder, as viewed in FIG. 2, partially sectioned.

Turning now to FIG. 2, upon assembly, tongue 30 of the frame 20 is inserted into the groove 64 of the clevis 40, the complementary dovetail configurations 32 and 66 serving as affixing means, to secure together the frame 20 and the clevis 40. The bracket 70 is nested within the clevis 40 so that the upper and lower arms 42 and 44 straddle the bracket 70, with the inclined surfaces 56 and 76 juxtaposed with one another and with the bearing surfaces 58 and 78 juxtaposed with one another, all in abutting relationship. As best seen in FIG. 3, the pins 60 and 62 of the clevis 40 are journaled within the respective apertures 80 and 82 of the bracket 70 and secure together the clevis 40 and the bracket 70, while enabling swinging movement of the frame 20 relative to the bracket 70 about the coincident transverse axes T and TT. The entire assembled sign holder 10 may then be attached to the price channel 12 and the sign 18 will be displayed at a display position wherein the frame 20 of the sign holder 10 projects laterally from the sign channel 12 to place the sign 18 directly before shoppers passing by the shelf 66.

Figure 4:
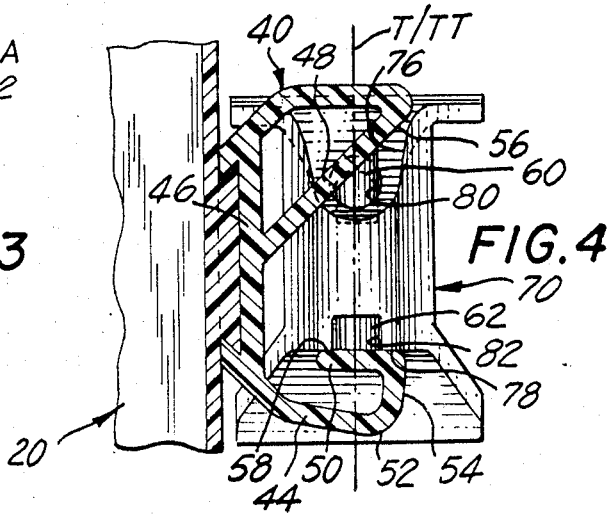
FIG. 4 is a view similar to FIG. 3, but with the component parts in a different operating position.

Should a shopper, or some other object, collide with the frame 20 of the installed protruding sign holder 10, the sign holder 10 will yield to the force of the collision by allowing the frame 20 to swing about the transverse axis T, out of the display position of the frame 20 and the sign 18, rather than resist the force. Referring now to FIG. 4, the swinging of the frame 20 swings the clevis 20 relative to the bracket 70, about the axes T and TT, out of the rest position illustrated in FIG. 3, by virtue of the journaled arrangement of the pins 60 and 62 and the respective apertures 80 and 82. The complementary inclined surfaces 56 and 76 serve as camming surfaces tending to move the inclined surfaces 56 and 76 apart in the transverse direction. That is, the swinging of the frame 20 about the axis T tends to move the upper arm 42 transversely upward away from the inclined surface 76 of the bracket 70. This upward movement will displace the entire clevis 40 upwardly, the upward movement of the clevis 40 being permitted by the resilient flexible nature of the lower arm 44 of the clevis 40, which not only permits the upward movement, but maintains the integrity of the assembled clevis 40 and bracket 70. To this end, the transverse spacing between the pad 50 and the free end 52 of the lower arm 44, as provided by the post 54, enables appropriate flexing of the lower am 44 while maintaining the desired bearing engagement between the first and second bearing surfaces 58 and 78. Thus, as seen in FIG. 4, bearing surfaces 58 and 78 remain in bearing engagement while the lower arm 44 is deflected downwardly. The flexing of the lower arm 44 establishes a resilient biasing force drawing the inclined surfaces 56 and 76 toward one another and tending to return the clevis 40 to its rest position, and the frame 20 to the display position of the sign 18. Thus, upon discontinuing the force which swings the frame 20 out of the display position of the sign 18, the biasing force of the resiliently flexible lower arm 44 will return the clevis 40 to the rest position and the frame 2 to the display position of the sign 18.

It will be seen that sign holder 10 has an exceptionally simple and economical construction. Tee bracket 70, the clevis 40 and the frame 20 each are constructed readily by molding each component part in a unitary structure of a relatively inexpensive synthetic resin material, such as polypropylene; however, other suitable synthetic resin materials will become apparent to those skilled in the choice of materials. The component parts are transported and stored readily, and are easily assembled for installation. The mechanism which allows the frame 20 to swing so as t yield to collisions and then restores the frame 20 to the display position of the sign 18 is a part of a unitary clevis 40 and a unitary bracket 70, requiring no additional springs or other complex component parts and additional assembly procedures. Thus, the sign holder 10 provides a simplified, lower cost construction which encourages the more widespread use of a safer sign holder, enables reliable operation to reduce any potential hazard to shoppers, reduces the frequency of replacement of the display signs, thereby saving not only the cost of the sign holders, but the labor involved in maintaining the signs in place, provides an aesthetically pleasing display which is effective, yet unobtrusive, provides a compact structure which utilizes a minimum of space at the installation site, as well as during shipping and storage, utilizes a minimum number of component parts, all of which may be constructed economically of inexpensive materials for reduced cost without compromising effectiveness, and enables reliable operation over a relatively long service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In a sign holder for use in connection with a price channel extending in a longitudinal direction along a shelf edge to locate a sign for display beyond the shelf edge in a display position where the sign projects laterally from the price channel and to bias the sign into the display position while permitting swinging movement of the sign to of the display position in response to forces applied to the sign holder in directions generally parallel to the longitudinal direction, the sign holder including a sign frame within which the sign is held and a bracket for selectively attaching the sign frame to the price channel, the improvement comprising:

a clevis having transversely opposite, laterally extending first and second arms and a transverse leg interconnecting the first and second arms;

affixing means for affixing the sign frame to the clevis;

a first camming surface on the clevis adjacent the first arm;

a first bearing surface carried by the second arm and confronting the first camming surface;

at least one of the first and second arms being resiliently deflectable in transverse directions relative to the other of the first and second arms;

a second camming surface on the bracket and being generally complementary to the first camming surface;

a second bearing surface on the bracket spaced transversely from the second camming surface and being generally complementary to the first bearing surface such that the clevis and the bracket may be nested in a rest position wherein the first camming surface is engaged with the complementary second camming surface, and the first bearing surface is engaged with the complementary second bearing surface; and pivot means connecting the nested clevis and bracket for pivotal movement of the clevis relative to the bracket about a transverse axis such that any movement of the sign frame away from the display position of the sign will result in pivotal movement of the clevis relative to the bracket and consequent operation of the first and second camming surfaces for deflection of at least one of the first and second arms transversely relative to the other of the first ad second arms to establish a resilient biasing force tending to return the clevis to the rest position and the sign frame to the display position of the sign.

2. The improvement of claim 1 wherein the first camming surface includes a first inclined surface on the clevis adjacent the first arm and extending at an angle toward the transverse leg, and the second camming surface includes a second inclined surface on the bracket complementary to the first inclined surface.

3. The improvement of claim 2 including a brace extending between the first arm and the leg of the clevis such that the first arm is braced against deflection relative to the leg, and the first inclined surface extends along the brace such that upon pivotal movement of the clevis relative to the bracket the second arm will be deflected transversely relative to the first arm.

4. The improvement of claim 3 wherein the first and second arms of the clevis straddle the bracket such that the bracket is nested within the clevis when the clevis and the bracket are nested, and the second arm will be deflected away from the first arm upon pivotal movement of the clevis in response to movement of the sign frame away from the display position of the sign.

5. The improvement of claim 4 including a pad, and a transverse post connecting the pad with the second arm such that the pad is spaced transversely from the second arm, the first bearing surface being located on the pad whereby resilient deflection of the second arm is permitted while the first bearing surface remains engaged with the second bearing surface.

6. The improvement of claim 5 wherein the clevis is a unitary structure molded of a resilient synthetic resin material.

7. The improvement of claim 1 wherein the clevis has a generally C-shaped overall configuration molded in a unitary structure of a resilient synthetic resin material.

* * * * *

UNITED STATES PATENT AND TRADEMARK OFFICE

CERTIFICATE OF CORRECTION

PATENT NO. : 4,909,464

DATED : March 20, 1990

INVENTOR(S) : Stanley L. Levine et al

It is certified that error appears in the above-identified patent and that said Letters Patent is hereby corrected as shown below:

Title page, Abstract, line 10, "the establishing" should read
-- and establishing --

Column 1, line 39, "the tape" should read
-- the type --

Column 1, line 64, "in longitudinal" should read
-- in a longitudinal --

Column 2, line 31, "th first" should read
-- the first --

Column 3, line 66, "shelf 66." should read
-- shelf 16. --

Column 4, line 3, "frame 20" should read
-- frame 20, --

Column 4, line 39, "Tee bracket" should read
-- The bracket --

Column 4, line 48, "as t yield" should read
-- as to yield --

Column 5, line 16, "sign to" should read -- sign out --

Signed and Sealed this

Ninth Day of July, 1991

*Attest:*

HARRY F. MANBECK, JR.

*Attesting Officer*

*Commissioner of Patents and Trademarks*